United States Patent [19]

Ahlgrimm

[11] Patent Number: 4,704,048

[45] Date of Patent: Nov. 3, 1987

[54] SUBTERRANEAN DRAINAGE

[76] Inventor: John Ahlgrimm, 2007 N. Division St., Appleton, Wis. 54911

[21] Appl. No.: 835,225

[22] Filed: Mar. 3, 1986

[51] Int. Cl.[4] ..... E02D 31/02

[52] U.S. Cl. ..... 405/45; 52/169.5; 210/170; 405/36

[58] Field of Search ..... 405/45, 48, 36, 43; 52/169.5; 428/178, 180, 116, 17; 210/170

[56] References Cited

U.S. PATENT DOCUMENTS

| | | | |
|---|---|---|---|
| 3,563,038 | 2/1971 | Healy et al. | 405/45 |
| 3,654,765 | 4/1972 | Healy et al. | 405/45 |
| 3,754,362 | 8/1973 | Daimler et al. | 52/169.5 |
| 4,045,964 | 9/1977 | Barclay | 52/169.5 X |
| 4,309,855 | 1/1982 | Pate et al. | 405/45 |
| 4,538,387 | 9/1985 | Barnett et al. | 52/169.5 |

FOREIGN PATENT DOCUMENTS 148345 10/1980 Norway .

*Primary Examiner*—Dennis L. Taylor
*Attorney, Agent, or Firm*—Thomas D. Wilhelm

[57] ABSTRACT

A panel assembly for use as a combination drainage and insulation member, primarily on the exterior surface of subterranean walls. The assembly has an insulating board with channels on one side of the board. A fabric which is pervious to water and impervious to soil particles, and has a high modulus, is attached to the channeled side of the board. The resulting board is highly effective to collect water and channel it downwardly toward a drainage pipe which may be part of the drainage system, and which usually conveys the water away from the wall. Improved methods of providing subterranean insulation and drainage are also disclosed.

37 Claims, 12 Drawing Figures

SUBTERRANEAN DRAINAGE

BACKGROUND OF THE INVENTION

This invention pertains to collecting liquid, particularly water, in the vicinity of subterranean structures and providing for its conveyance to a safe place as regards the subterranean structure. It is particularly useful adjacent up-standing subterranean walls where it provides thermal insulation to reduce heat loss by conduction through the wall.

When constructing a below grade concrete wall for a building or other structure, certain problems have arisen in conventional construction practice. Walls which are built without insulation are energy wasters. Also, any water leakage through the wall can damage both the wall and the interior of the building. So it is important to control transmission of water through the wall to the building interior, and to control transmission of heat through the wall to the surrounding soil outside the building. These issues are of even greater significance where habitable area is desired below ground level.

When insulating walls, insulating on the exterior portion of these foundation walls usually proves to be the most advantageous. Most insulation materials and products are combustible and will ignite and burn readily, even though some are treated for fire retardation. With the insulation on the exterior surface of the subterranean wall, this is not a problem; and so insulation is usually put on the exterior surface of the wall, with one major reason being fire safety.

The exterior subterranean environment, though, presents its own series of problems and requirements of an insulation material, which must be met in order for the insulation to functionally retain its insulating value. The main requirements are that the insulation must have an adequate resistance to compressive load, and it should not absorb a significant quantity of water. If the insulation compresses appreciably, or if it absorbs a significant amount of water, its insulating value is reduced. Particularly if the insulation absorbs water, and if freeze and thaw conditions exist, the expansion and contraction of moisture particles can damage the insulation.

As mentioned earlier, it is desirous that walls both be insulated and have water kept away from them, to prevent problems of excessive heat loss, and moisture damage.

In order to prevent water leakage and/or hydrostatic pressure on subterranean walls, in most cases, a drainage system is used in the vicinity of the wall. Hydrostatic pressure is caused by water in the surrounding soil which exerts forces on the wall. This force, if excessive, could crack or severely damage the wall.

Conventional drainage systems are time consuming to install and are relatively expensive. One conventional system uses drain tile and crushed rock around the footings of the wall. This is effective only if the soil permeability (K-cm/sec) is high enough to allow the water to flow to and into the system. If not, and commonly, water could leak into the basement or build up hydrostatic pressure against the wall, as this system does not provide a barrier to prevent ground water from reaching the wall.

Particularly during heavy rains, or during winter or spring melting of snow, soils often are not permeable enough to permit the water to efficiently seep through and into the footing drainage system.

Walls can be more or less waterproofed with certain commercially available materials, but these materials are not effective to stop water leakage should a crack develop in the wall. And, given time, many walls develop cracks. So it is highly desirable that water contact with the wall surface be minimized, and it is especially desirable that water be prevented from reaching the wall surface.

Certain products are commercially available to convey water into drain tile at the footings, but they are not capable of concurrently providing insulation.

U.S. Pat. No. 3,654,765 Healy et al teaches a drainage manufacture using a core member of "foamed polystyrene". But many foamed polystyrenes are unacceptable because of excessive moisture absorption, and so Healy et al does not solve the problem of providing concurrently, insulating properties, lack of water absorption, and conveyance of moisture away from the wall. Likewise the Healy et al patent teaches, as regards the fabric covering, only that it be pervious, and that it have "suitable mesh and thickness that solid particles will be held back or pass through one opening but will not remain in a position so as to clog the opening."

U.S. Pat. No. 4,309,855 Pate et al teaches a channelled polystyrene foam board having a covering of a synthetic resin film having very small capillaries which extend through the film. At the base of the board is a bead pack for conveying water from the board to the drain pipe.

U.S. Pat. No. 4,538,387 Barnett et al further teaches using a fibrous material quilted to the fabric covering.

It is an object of the invention to provide an improved product for subterranean drainage.

It is another object to provide such a product which concurrently provides thermal insulation.

It is yet another object to provide an improved method of providing subterranean insulation and drainage.

It is still another object to provide a improved unitary product which concurrently provides subterranean drainage, thermal insulation, and low water absorption; such that all three features are obtained by the installation of the single unitary product, or a series of substantially similar unitary products.

SUMMARY OF THE INVENTION

These and other objects are achieved in the invention. In one sense, the invention is seen to be embodied in an improved insulating board. The board has opposing outer surfaces, a top edge, a bottom edge, and two side edges. One of the outer surfaces has a plurality of channels extending inwardly from the surface, for conducting liquid toward the bottom of the board. The side edges of the board have channels therein extending toward the bottom of the board, these channels extending from the side edges onto the one outer surface.

In another embodiment of the improved insulating board, the board may have a groove extending along the length of the top edge of the board and intersecting the channels which extend inwardly into the board.

Preferably the channels which extend from the one outer surface are narrower at the outer surface then inwardly of the surface.

In another sense, the invention is seen in an improved panel assembly using the improved boards of the invention. In the assembly, the front surface of the board, which contains the channels, has a covering of a liquid pervious fabric extending over it. The fabric further extends around both side edges and onto the back surface of the board.

The fabric needs to be firmly attached to the board. The attaching means is mechanical, as foamed plastics boards fail cohesively adjacent the adhesive layer when adhesion is attempted for use as the means of attaching the fabric to the board. The mechanical attachment may go through the board and attach to the fabric. It may reach around the board, as a clamp. Finally it may hold the fabric to the board by a joining action which uses a substantial portion of the board thickness, but does not go all the way through it.

One preferred mechanical attachment means is staples. The staples extend through the fabric on the front of the board, through the board, and through the fabric which is on the rear of the board about the board edges. Another preferred mechanical attachment means is a combination of an appropriately sized elongated rod wedged into one of the channels, with the fabric being trapped in the channel by the rod. Preferably, in this embodiment, channels are made on the back surface of the board specifically to receive the fabric-rod combination. In some embodiments, rods are used on both the front and rear of the board, and may be used with or without staples in combination.

The channels in the front and rear surfaces are preferably narrower at the board surface than inwardly of the board surface.

In another sense, the invention is seen to be broadly embodied in a panel assembly for collecting liquid and conducting it in a predetermined direction. The insulating board is comprised of a rigid, foamed polymer, and has opposing outer surfaces. One of the outer surfaces has channels extending inwardly from the surface, for conducting liquid in the predetermined direction. The covering is of a liquid pervious fabric attached to and extending over the one surface of the board and its respective channels. The fabric has a high stress/strain modulus. Preferred fabric is a spun-bonded nonwoven, preferably a polyolefin.

In preferred panel assemblies, the combination of the design of the channels, the stress/strain modulus of the fabric, and the attachment of the fabric to the board is such that, under normal earth loading on building foundations, the fabric remains spaced from at least portions the interior surface of of the channels.

Also in preferred assemblies, the stress/strain modulus of the fabric at 5% elongation is greater than at least about 30 pounds.

Preferred foam boards have water absorption of no more than about 0.20 percent by volume. Boards having skins on the outer surfaces are preferred, as the skins tends to contribute toward minimizing the amount of water absorption. Preferred boards also have primarily closed cells in the foam matrix, which also helps prevent water absorption.

In another sense, the invention is seen to be embodied in a panel assembly for collecting liquid adjacent a subterranean wall and conducting it in a predetermined direction. Another way of defining the board is that it is comprised of a rigid, closed cell foam having a water absorption of no more than about 0.20 weight percent, and having opposing outer surfaces. Each of the outer surfaces has a skin. One of the outer surfaces has channels extending inwardly from it, for conducting liquid in the predetermined direction. The corresponding covering of a liquid pervious fabric is attached to and extending over the one surface of the board and its respective channels. The fabric, here, optionally has a high stress/strain modulus, and is again preferably spunbonded, most preferably a spunbonded polyolefin. Similarly, the combination of the design of the channels, the stress/strain modulus of the fabric, and the attachment of the fabric to the board is such that, under normal earth loading on building foundations, the fabric remains spaced from at least portions of the channels.

Any of the panel assemblies of the invention may be so designed as to have a plurality of edges on the board proximate and generally between the outer surfaces. The channels intersect at least one of the edges. Portions of the fabric adjacent the one edge are attached in the assembly adjacent the outer surface and have an edge of the fabric in the vicinity of the one edge.

In yet another sense, the invention is seen in a subterranean drainage system in essentially surface to surface relationship with an upstanding wall. The system includes a panel assembly of the invention, particularly one using improved board of the invention, adjacent the wall, for collecting liquid and conducting it downwardly. Propinquant the lower edge of the panel assembly is means, such as a pipe, for conveying liquid along a generally horizontal axis. The conveying means has liquid inlets for receiving liquid exiting the panel assembly.

In some embodiments, the fabric is prevented from extending substantially over the liquid conveying means.

In still another sense, the invention is seen to be in a method of providing a simple and efficient assemblage of components to effect subterranean insulation of an up-standing subterranean wall, and concurrently, and with the same basic material assemblage, drainage adjacent the wall. The method includes the steps of fabricating a panel assembly, of the invention, and emplacing, adjacent the wall, drainage pipe, or the like, for conveying liquid along a generally horizontal axis. The pipe has suitable liquid inlets for receiving liquid from the surrounding soil, and from the panel assembly which is emplaced against the wall and above the conveying means. The assembly surface against the wall has a substantially planar surface. The other surface has channels in it which are oriented for channeling liquid downwardly toward the conveying means.

DETAILED DESCRIPTION OF THE INVENTION

The invention is specifically concerned with improved panel assemblies for use in drainage of water away from subterranean construction. Usually, a portion of the constructed object projects from the ground, though the invention may be satisfactorily used with construction which is totally under the surface of the terrain. And while the invention is described herein with regard to structures which do project above the ground, it will be appreciated that the principles of the invention apply equally well to below surface structures.

Figure 1:
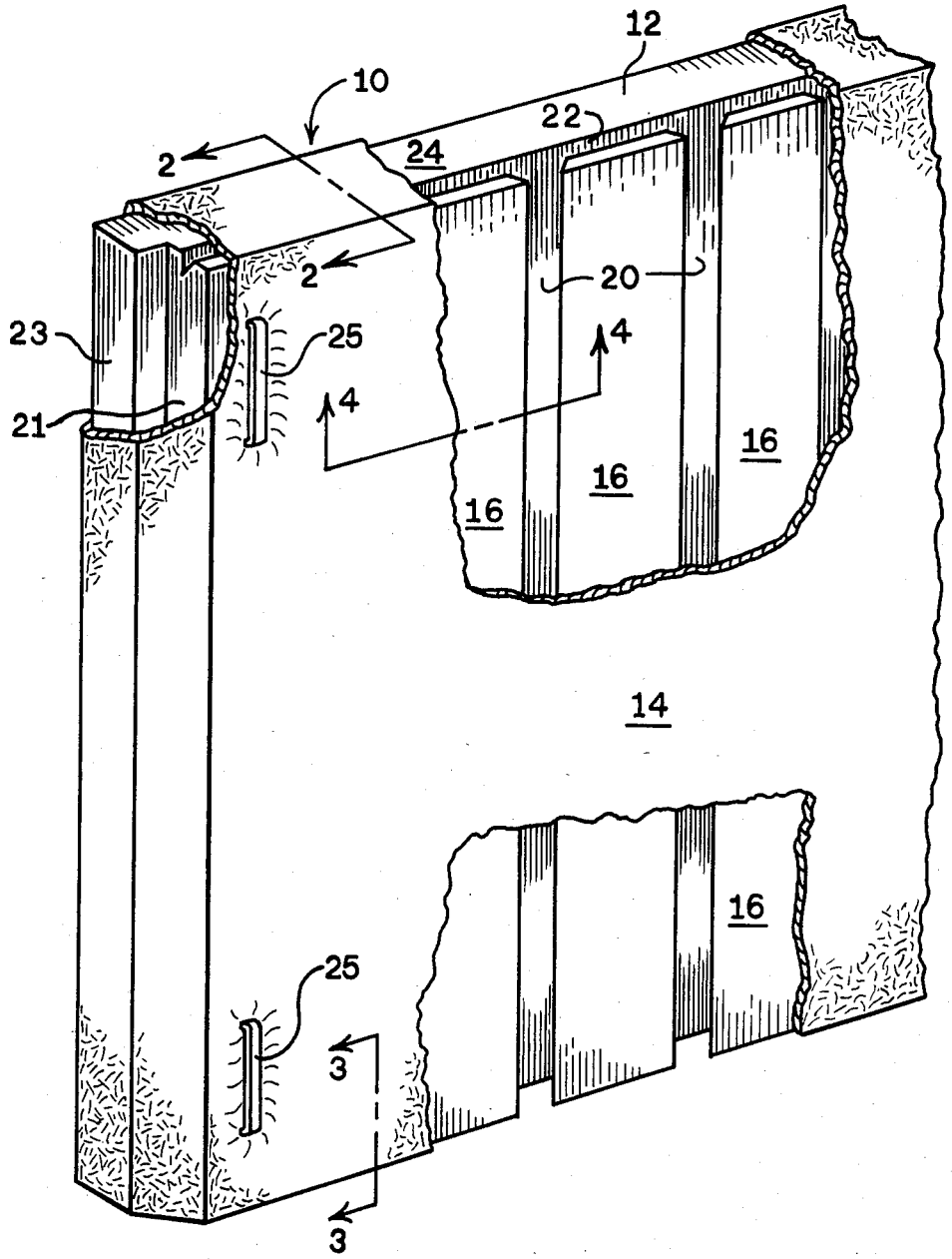
FIG. 1 is a generally a pictorial view of a fragment of a panel assembly of this invention, with portions cut away and in cross-section.

The panel assemblies of the invention are preferably made in large sheets, such as 4 ft. by 8 ft. for installation edge to edge and/or top to bottom. FIG. 1 shows a portion of a foreshortened panel assembly of the invention. The drawing shows generally the left side of the panel assembly, with fabric cut away from portions of the top, the bottom, and the left edge.

The panel assembly, which is generally designated 10 has three primary conponents, namely an insulating board 12 a covering fabric 14, and some means for firmly attaching the fabric to the board.

The board 12 is a rigid and generally non-compressible insulating foamed polymer. Preferred foams have closed cells and a generally continuous surface skin. The surface skin generally prevents water from entering the board wherever the skin is continuous. To the extent water does enter the board, such as at a break in the skin, the closed cell configuration limits the penetration of the water into the foam interior to a minimal amount beyond the depth of the break. In some embodiments where the skin may not be continuous, the foam cells are the primary means for preventing the penetration of water into a substantial portion of the foam board; as such penetration reduces thermal insulating efficiency and may allow the water to reach the wall which is desired to be insulated and kept dry.

A preferred board 12 is made from extruded polystyrene foam in the weight range of about 2 pounds per cubic foot to about 8 pounds per cubic foot. Polystyrene foam so made is rigid, has closed foam cells and has a skin on surfaces of the board. Water absorption is in the range of about 0.2% or less, using ASTM C272. By contrast, a less preferred embodiment, made from expanded polystyrene beads, has more passages between the foam cells, namely a partially open cell network, and is not as effective at controlling water travel internally in the board. Further, expanded bead boards generally have either no skin or an inferior skin, and so water control within the board is a more difficult problem overall because of the combination of a less effective skin and a more open cell network. Nonetheless, a significant aspect of the invention is in the use of a particular covering fabric in subterranean applications and attendant advantages of using that fabric, and so the invention may include use of the more open cell network, such as bead boards, with the fabric, though these are less preferred.

The board 12 has major front and back outer surfaces 16 and 18 which preferably have skins as discussed above. Channels 20 extend inwardly from surface 16 and generally extend in one direction the entire length of the board 12. Channels 21, on either side edge of the board, extend from the front surface 16 onto the side edge 23. Channels 20 and 21 may be formed as part of forming the board 12, by appropriate design of the extrusion die, for extruded foam boards, in which case the corners and edges of the channels 20 may be more rounded than those shown in the FIGURES, and the interior channel surfaces may have skin. The board 12 may also be made in a two-step process. The first step is forming the board in conventional manner such that both surfaces, as at 16 and 18 are essentially planar and without channels. The channels 20 are then cut into one surface, as at 16, by appropriate forming means, such as a router, or a moulding head. Groove 22 may similarly be formed on top edge 24. The purpose of the channels 20 and 21 is to conduct liquid in a predetermined and desired direction, as by gravity flow vertically. Groove 22 serves as a header for distribution of liquid initially collected above a given board and channeled downwardly to it.

Figure 2:
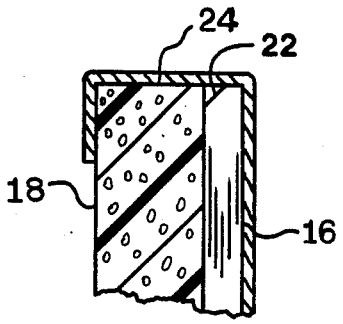
FIG. 2 is a cross-section of the top of the panel assembly of FIG. 1 taken at 2—2 of FIG. 1, with an alternate construction of the top of the assembly being shown as FIG. 2A.
Figure 10:
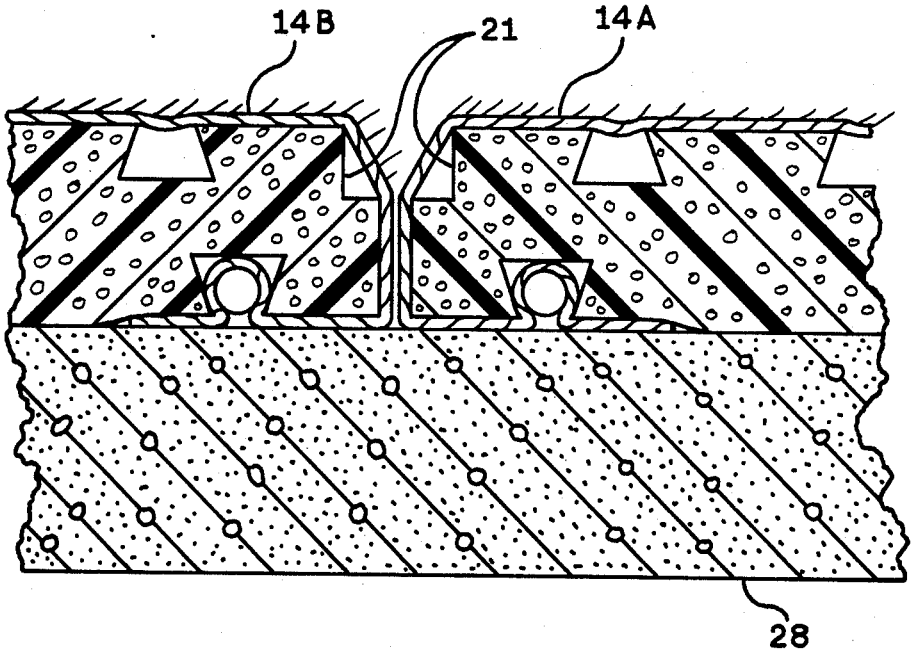
FIG. 10 is a cross-section showing a vertical joint between two panel assemblies of the invention.

Fabric 14 serves as a covering over the board 12. Fabric 14, in general, covers the entire surface 16 of board 12, extends over the top and side edges 23 and 24 and extends onto rear surface 18, all as best seen in FIGS. 1, 2, and 10. The fabric is readily pervious to the passage of water and as such permits water to pass through it and into channels 20. Fabric 14 also has an equivalent opening size (EOS) which is capable of preventing soil particles from moving through the fabric in a subterranean installation. Namely, soil particles are prevented from moving through fabric 14 and into channels 20 where they could fill up a portion of the channel, effectively blocking further flow of water. The EOS of the fabric may vary, depending on soil texture and condition. A fine soil requires a fine fabric, whereas a coarser EOS fabric may be used with a coarser soil.

Fabric 14 is attached to board 12 in such a way that it extends over the surface 16 and protects the channels 20 from encroachment of any soil; such that the fabric serves as a barrier to entrance of soil while it is pervious to passage of water. The press of soil against the fabric may be substantial, as in back-filled areas, placing substantial stress on the fabric and urging it into channels 20 and 21. The overall nature of the fabric is such that it is tough and relatively non-extensible. It has a high stress/strain modulus in both the with machine direction and the cross machine direction. A highly desirable material requires a stress of at least about 30 pounds per inch width to obtain a 5% elongation, as determined by ASTM D-1682-64 (1975).

Figure 6:
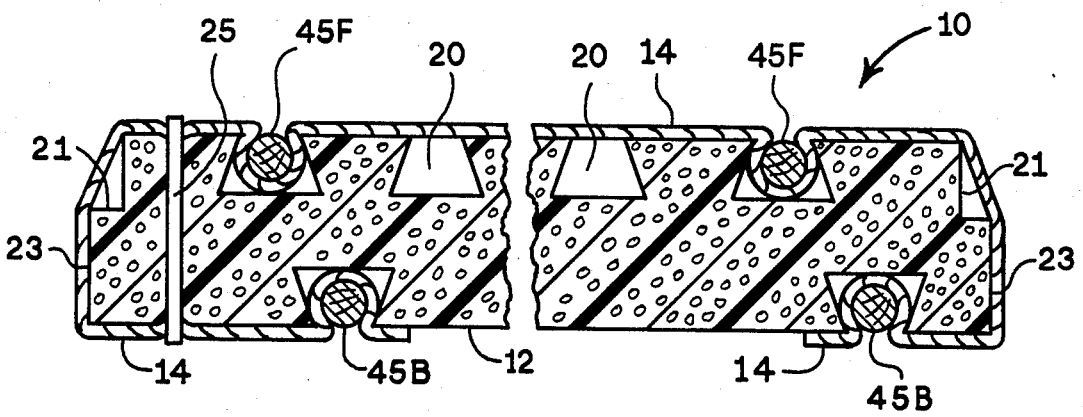
FIG. 6 is a cross-section similar to FIG. 4 showing another means of assembling the fabric to the board.

In addition to the fabric having good resistance to elongation, tear, and punctures, it must be firmly attached to board 12. And while adhesive gives strong attachment to the board, the board is cohesively rather weak such that an adhesively attached fabric is readily removed from the board by cohesive separation of the outer skin from the board. So a non-adhesive mechanical attachment is required. One such attachment is embodied in staples 25, as seen in FIGS. 1 and 6. The staples extend through fabric 14 on the front of the board, through the board, and through fabric 14 on the back of the board; as seen in FIG. 6.

Another means of attachment is the use of rods 45, which are press-fitted into channels 20, trapping the fabric 14 between the rods 45 and channels 20; and thereby creating a firm holding attachment of the fabric to the board.

In order for rods 45 to function properly in their holding function, the rods and channels must both be appropriately sized for proper fit. Likewise, it is important that channels 20 be narrower at the surface 16 or 18, as appropriate, than inward of the surface, in order to grip and hold rods 45. Rods 45 may be used in both front and back of the board as at 45B and 45F in FIG. 6; or may be used on only one side.

The narrower opening of channels 20 aids in retaining rods 45. It also minimizes the gap which is bridged by fabric 14, thereby reducing the unsupported stressed area, such as that seen in FIG. 5.

For mechanical attachments which use the board thickness for strength, it is highly desirable that the attachment device attach to the fabric on both front and rear of the board, to take benefit from the substantially strong fabric.

Preferred fabrics are spun-bonded nonwoven, being relatively inexpensive and readily available. Preferred materials are the polyolefin polymers, and especially polypropylene. The advantages of the spunbonded polyolefins are in their ability to pass water while retaining soil particles, at an economical price; and their relative inextensibility. One highly desirable material for fabric 14 is a spun-bonded polypropylene sold by DuPont Company under the tradename Typar.

Figure 4:
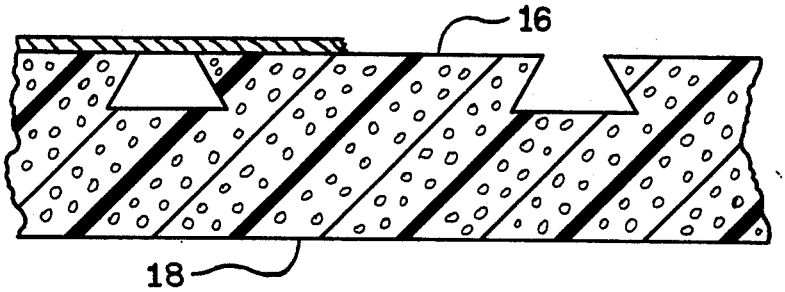
FIG. 4 is a cross-section across the width of the panel assembly of FIG. 1, taken at 4—4 of FIG. 1.
Figure 5:
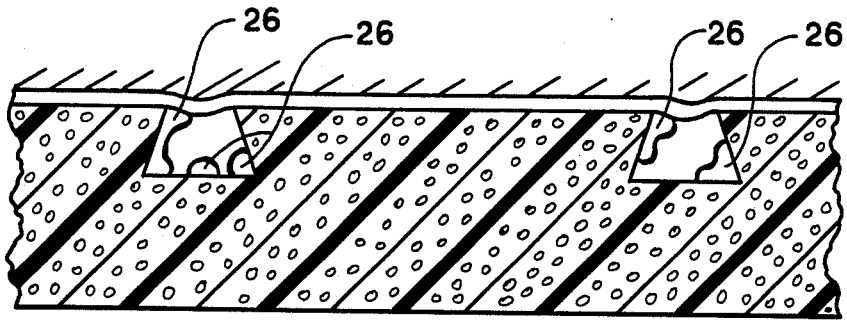
FIG. 5 is a cross-section similar to FIG. 4 and showing water in the channels and the deflection of the fabric into the channels due to ground and/or hydrostatic pressures.

As used in the invention herein, it is highly desirable that the fabric have a high stress/strain modulus ratio, such that substantial stress may be exerted on the fabric as by subterranean soil loading, whether wet or dry, without excessive stretching of the fabric 14 into the channels 20. FIG. 4 shows the unstressed fabric, where the fabric extends straight across channels 20. FIGS. 5 and 10 show the fabric 14 being stressed by soil loading, and depressing the fabric 14 slightly into the channels 20. It is significant and important that fabric 14 does not make excessive intrusion into channels 20, which intrusion could interfere with flow of water in channels 20. Thus the fabric 14 is, at all times, spaced from at least some portions of the interior of each channel, and preferably is spaced from all portions of each channel surface, such that water 26, as seen in FIG. 5, may have a free travel path in channels 20 for the length of the channels.

In less preferred embodiments, the improved boards of the invention may be used with other, and more extensible fabrics. While such fabrics are not preferred, they can be made into useful panel assemblies.

Figure 7:
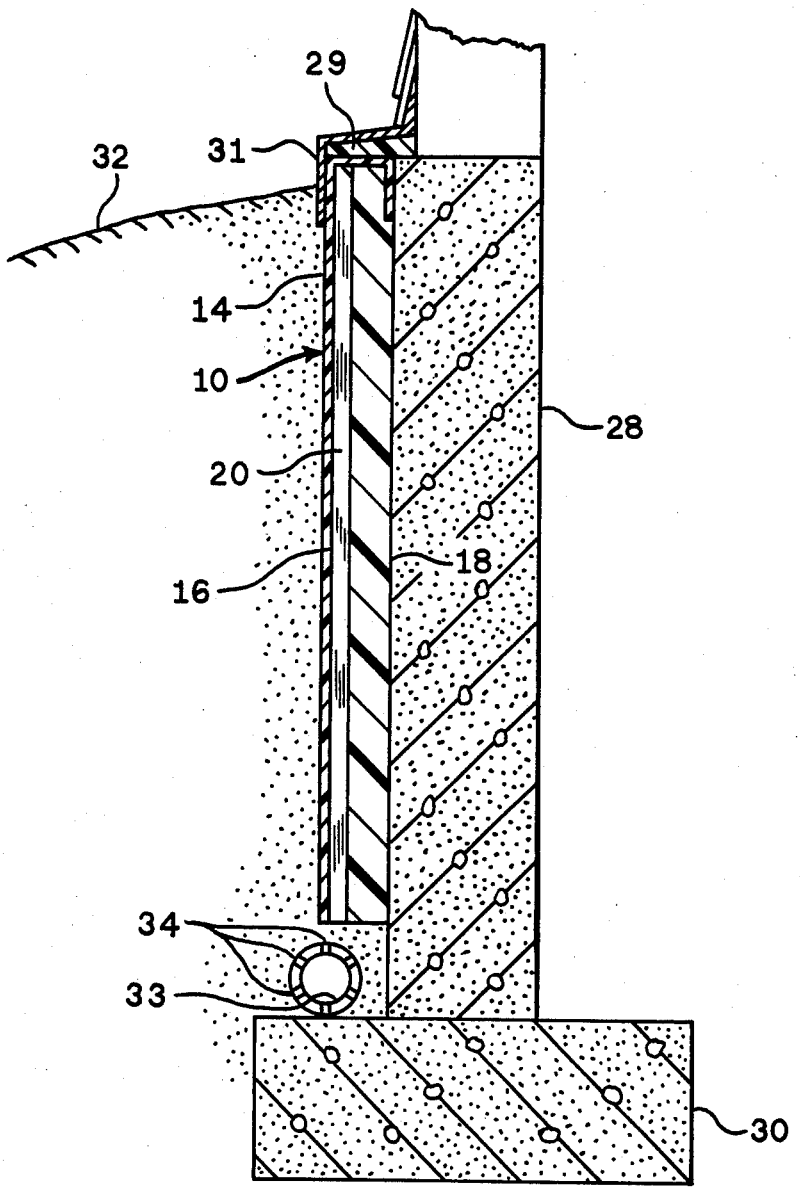
FIG. 7 is a cross-section showing a panel assembly of the invention used in conjunction with a drainage pipe adjacent an upstanding subterranean wall, to make a drainage system.

Referring, now, to FIG. 7, a subterranean wall 28 is on a foundation 30. Wall 28 projects above ground level 32. A panel assembly 10 of the invention is in general surface to surface contact with wall 28. As best seen in FIG. 7, in exaggerated depiction, fabric 14 preferably extends over top 24 and its edge is between the surface 18 of board 12 and the surface of wall 28. Additional insulation 29 and a molding 31 cover the top of the panel assembly 10. Drainage pipe 33 is essentially horizontal, with drain slope, and is on footing 30. Panel assembly 10 is above pipe 33, and the juxtaposition of pipe 33 and assembly 10 are such that they form a subterranean drainage system wherein water collected by assembly 10 drains by gravity downwardly and is discharged from the assembly adjacent pipe 33. The water then seeps into pipe 33 through entrances 34, and the water is drained away from the wall through pipe 33. It is preferable that fabric 14 extend slightly below bottom edge 36 of panel 10 in order to discourage packing of foreign matter in the bottom of channels 20. However, long extensions below edge 36 are not necessary, and make a more complicated installation. Thus it is preferred that fabric 14 terminate at a fabric edge in the vicinity of the bottom edge 36 of the board.

Figure 8:
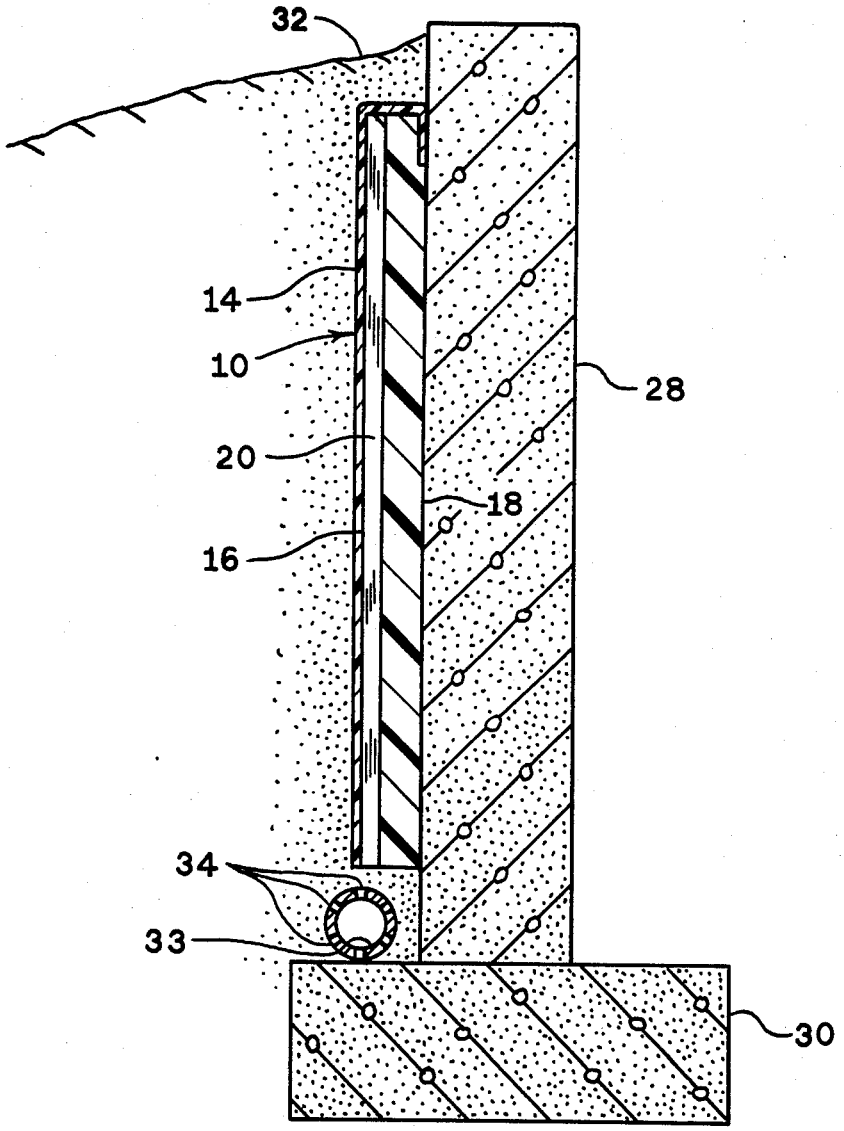
FIG. 8 is a cross-section of an alternate embodiment of the drainage system shown in FIG. 7.

A less preferred embodiment is seen in FIG. 8 wherein the top of the assembly is below ground level 32 such that the wall is not thermally insulated between ground level 32 and the top of the assembly. Nevertheless, the assembly does perform its intended function, although less efficiently for thermal performance.

The location of pipe 33 is not particularly critical so long as water exiting the panel assembly can travel by gravity to the pipe 33, or to other conveying means such as a bed of graded gravel which provides adequate spacings for water travel.

Likewise, panel assembly 10 may or may not cover the entire upstanding surface of wall 28. Or it may extend all the way down to the footing. Or panel 10 may comprise one panel element atop another element.

Figure 2A:
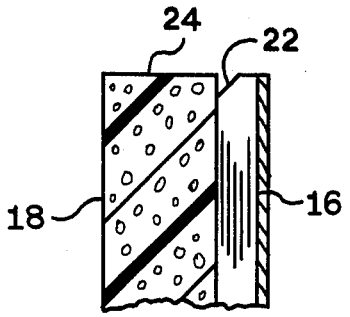
Figure 3:
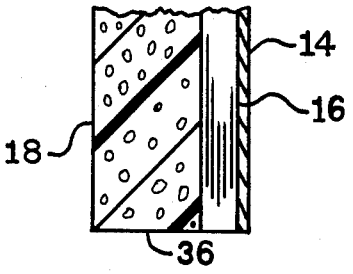
FIG. 3 is a cross-section of the bottom of the panel assembly of FIG. 1 taken at 3—3 of FIG. 1, with an alternate construction of the assembly being shown as FIG. 3A.
Figure 3A:
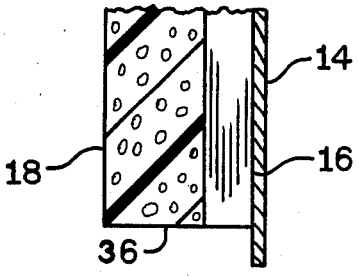
Figure 9:
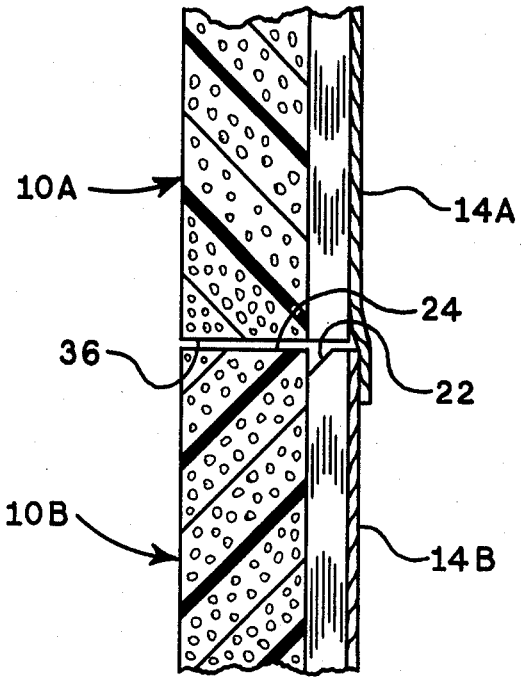
FIG. 9 is a cross-section of portions of two panel assemblies of the invention where one is atop the other, and showing an horizontal joint.

It is preferable, overall, that fabric 14 extend slightly below the bottom edge 36 of board 12, so that it provides a bit of bottom protection. It also provides a covering of the joint where one panel is atop the other as seen in FIG. 9. In FIG. 9, the bottom of fabric 14A on panel 10A, adjacent its bottom edge 36 overhangs the top of fabric 14B on panel 10B, thus protecting the more or less horizontal joint between panels 10A and 10B from intrusion by unwanted foreign matter, such as soil. The joint could be similarly protected by tape. It is noteworthy that, in this type of construction where one panel is atop another, the top of the lower panel is preferably of the alternate design as in FIG. 2A, such that water collected by the upper panel may pass directly to the lower panel without having to pass through fabric 14 again, as would be the case if the primary design of FIGS. 1 and 2 were used for the lower panel. It is usually desirable that the upper panel have the top fabric covering as in FIG. 2. Such top covering may be superfluous, though, in installations such as shown in FIG. 7. And the lower panel should have groove 22 to serve as a distribution header for water drained from the upper panel.

In similar treatment, FIG. 10 shows a top view of a cross-section of a vertical joint between side-by-side panels in edge-to-edge relationship. The edges have complimentary edge channels 21 which form a pseudo-channel for draining water at the edge of the panel.

One embodiment of a panel assembly of this invention is made with an extruded polystyrene board 4 feet wide by 8 feet long; having a nominal thickness of $1\frac{1}{2}$ inches. Grooves nominally $\frac{1}{2}$ inch deep and trapezoidally shaped as seen in FIG. 1 are $\frac{1}{4}$ inch wide at the board surface and $\frac{1}{2}$ inch wide at the base of the trapezoid. The grooves are spaced parallel to each other on approximately 2 inch centers across the width of the board. Fabric of Typar, which is 15 mils thick and weights 3.0 oz/yd is attached to the board by use of $\frac{3}{8}$ inch diameter rods in grooves in the back surface; as at 45B in FIG. 6. The Typar extends over the top edge and around the side edges, and onto the back, and also extends somewhat below the bottom edge.

The size and spacing of channels in the board are matters of design choice. For more extensible fabric, the channels may be deeper to ensure that the extended fabric does not close off the channels under backfill pressure. For less extensible fabric, channels may be shallower. The shallower channels leave a thicker layer of effective insulation, as compared to deeper channels in the same board; so shallower channels are preferred, so long as they are effective to collect and drain the water adjacent the assembly.

In general installation and use, the insulating panel assembly is placed against the outside of the subterranean wall and soil or other fill is then placed against it. The amount and texture of fill placed against the panel will vary with the given structure, soil, and water, etc. conditions. The panel may cover only that portion of the wall 28 which is below ground level, as in FIG. 8. Preferably, however, the panel assembly projects to the top of the foundation wall as seen in FIG. 7.

Water in the soil, and adjacent the panel, permeates through the fabric 14. With the appropriate selection of equivalent opening size, the fill/soil is prevented from passing through the fabric. By permeation through the fabric, water from the soil enters a channel 20 which serves as a path or passage way, at reduced hydrostatic pressure. As the water collects in large enough droplets, it runs, or falls, by gravity, down the respective channel to the bottom of the panel; where it exits the channel and the panel, and passes into the pipe or other conveying means for conveyance away from the wall.

The amount of water collected and conveyed varies according to soil conditions, moisture conditions, and changes in them. At some times, no water may be collected at all. At other times, substantial quantities may be collected. And so the channels and pipe are sized and designed for the maximum anticipated collection load.

Thus the panels of this invention act as somewhat of an insulating, hydraulic safety valve, to relieve hydrostatic water pressure while providing dry insulating properties to subterranean walls.

Returning now to FIG. 6, it is seen that the unitary panel assembly 10 provides collection and drainage of water through channels 20 while at the same time providing insulation by means of board 12 and, in preferred embodiments, preventing water from penetrating the insulation by virtue of closed foam cells and, further, by virtue of the skin on the foam. Because the insulation stays dry, it retains its excellent thermal insulating properties and discourages seepage of water to the surface of wall 28; such that wall 28 tends to stay dry, as water is efficiently carried away.

As seen in FIG. 9, water being drained from an upper panel 10A should enter channels 20 of the lower panel 10B. Where channels 20 on the upper and lower panels do not readily line up, the water drains into groove 22 and runs laterally to channels 20 which are intersected by groove 22. Thus, misalignment of upper and lower panels is of little consequence and is readily accommodated.

Thus it is seen that the invention provides an improved product for subterranean drainage. The product of the invention further provides the improved drainage in combination with thermal insulation in a unitary product.

Having thus described the invention, what is claimed is:

1. A panel assembly for collecting liquid and conducting it downwardly, said panel assembly comprising:

(a) an insulation board having opposing outer surfaces, a top edge, a bottom edge, and two side edges, one of said outer surfaces having first channel means extending inwardly therefrom for conducting liquid toward said bottom of said board: and (b) a covering of a liquid pervious fabric having a high stress/strain modulus firmly attached to said board and extending over said one surface of said board, such that said fabric cannot be deformed by stretching to substantially intrude into said channels under normal earth loading conditions of typical subterranean foundations.

2. A panel assembly as in claim 1, said side edges of said assembly having second channel means extending onto said one outer surface.

3. A panel assembly as in claim 1, said top edge having a groove extending along the length of said top edge and intersecting said first channel means.

4. A panel assembly as in claim 2, said top edge having a groove extending along the length of said top edge and intersecting said first channel means.

5. A panel assembly as in claim 1, 2, or 3 said fabric extending onto said other outer surface, and being attached to said board by staples extending through said fabric on said one outer surface, through said board, and through said fabric on said other outer surface.

6. A panel assembly as in claim 2, or 3, said board having third channel means on the other of said outer surfaces near said side edges, said fabric extending around said side edges and over said third channel means, said fabric being attached to said board by appropriately sized elongated holding means wedged into said third channel means, said fabric being firmly held between said elongated holding means and said board.

7. A panel assembly as in claim 6, and including an additional elongated holding means on said one outer surface, wedged into said first channel means, said fabric being firmly held between said elongated holding means and said board.

8. A panel assembly as in claim 6, attachment of said fabric to said board being further effected by staples extending through said fabric and said board, from one of said outer surfaces to the other of said outer surfaces.

9. A panel assembly as in claim 7, attachment of said fabric to said board being further effected by staples extending through said fabric and said board, from one of said outer surfaces to the other of said outer surfaces.

10. A panel assembly as in claim 1, 2, or 3, said fabric being attached to said board by mechanical attaching means.

11. A panel assembly as in claim 1, 2, or 3, said fabric extending onto said other outer surface, and being attached to said board by mechanical attaching means spanning the thickness of said board and holding said fabric to said board on both said outer surfaces.

12. An insulating foam board having insulating properties of at least about R4 per inch before extended underground exposure, said board comprising opposing outer surfaces, a top edge, a bottom edge, and two side edges, one of said outer surfaces having first channel means extending inwardly therefrom, said channel means being narrower at said outer surface then inwardly thereof, such that a fabric having a high stress/-strain modulus, when firmly attached to said board, has a reduced tendency to intrude into said channels under normal earth loading conditions of typical subterranean foundations, and including a covering of a liquid pervious fabric having a high stress/strain modulus attached to and extending over said one surface of said board.

13. A subterranean drainage system made with a panel assembly of claim 1, 2, 3, or 4.

14. A subterranean drainage system made with a panel assembly of claim 5.

15. A subterranean drainage system made with a panel assembly of claim 6.

16. A subterranean drainage system made with a panel assembly of claim 7.

17. A subterranean drainage system made with a panel assembly of claim 10.

18. A panel assembly for collecting liquid and conducting it in a predetermined direction, said panel assembly comprising:

(a) an insulating board, said board being comprised of a rigid, foamed polymer, and having opposing outer surfaces, one of said outer surfaces having channel means extending inwardly therefrom, for conducting liquid in said predetermined direction; and (b) a covering of a liquid pervious fabric attached to and extending over said one surface of said board and its respective channel means, said fabric having a high stress/strain modulus, such that said fabric cannot be deformed by stretching to substantially intrude into said channels under normal earth loading conditions of typical subterranean foundations.

19. A panel assembly as in claim 18 wherein said fabric is a spun-bonded nonwoven.

20. A panel assembly as in claim 18, the combination of the design of said channel means, the stress/strain modulus of said fabric, and the attachment of said fabric to said board being such that, under normal earth loading on building foundations, said fabric remains spaced from at least portions of said channel means.

21. A panel assembly as in claim 18 wherein stress/-strain modulus of said fabric at 5% elongation is greater than at least about 30 pounds.

22. A panel assembly as in claim 18 wherein said board has a water absorption of no more than about 0.20 percent by volume.

23. A panel assembly as in claim 21 wherein said board has a water absorption of no more than about 0.20 percent by volume.

24. A panel assembly as in claim 18, said board comprising a closed cell polystyrene foam, each of said outer surfaces comprising a skin.

25. A panel assembly as in claim 19 wherein said fabric is made from essentially endless elements.

26. A panel assembly as in claim 24, wherein surfaces of said channel means comprise skin.

27. A panel assembly for collecting liquid adjacent a subterranean wall and conducting it in a predetermined direction, said panel assembly comprising:

(a) an insulating board, said board being comprised of a rigid, closed cell polystyrene foam having a water absorption of no more than about 0.20 weight percent, and having opposing outer surfaces, each of said outer surfaces comprising a skin, one of said outer surfaces having channel means extending inwardly therefrom, for conducting liquid in said predetermined direction; and (b) a covering of a liquid pervious fabric attached to and extending over said one surface of said board and its respective channel means, said fabric having a high stress/strain modulus, such that said fabric cannot be deformed by stretching to substantially intrude into said channels under normal earth loading conditions of typical subterranean foundations.

28. A panel assembly as in claim 27, said fabric being a spun-bonded nonwoven polyolefin.

29. A panel assembly as in claim 27 wherein said fabric is made from essentially endless elements.

30. A panel assembly as in claim 27 wherein the stress/strain modulus of said fabric at 5% elongation is greater than at least about 30 pounds.

31. A panel assembly as in claim 18 or 27 wherein said board has a bottom edge proximate said outer surfaces, said bottom edge being oriented at an angle intersecting said outer surfaces, said channel means intersecting said bottom edge, portions of said fabric adjacent said bottom edge having an edge of said fabric in the vicinity of said bottom edge of said board, said fabric covering said one surface at said bottom edge, such that said fabric requires minimal manipulation separate from said board during installation thereof, and such that said fabric protects said channels in said one surface, at said bottom edge, from intrusion thereinto by backfill material in a subterranean installation.

32. A subterranean drainage system in essentially surface to surface relationship with an upstanding wall, said system comprising:

(a) a panel assembly adjacent said wall, for collecting liquid and conducting it downwardly, said panel assembly having a lower edge and comprising (i) an insulating board comprised of a rigid, foamed, closed cell polymer, and having opposing outer surfaces, one of said outer surfaces having channel means extending inwardly therefrom, for conducting liquid downwardly, (ii) a covering of a liquid pervious non-woven fabric attached to and extending over said one surface of said board and its respective channel means, said fabric having a high stress/strain modulus, such that said fabric cannot be deformed by stretching to substantially intrude into said channels under normal earth loading of typical subterranean foundations; and (b) propinquant said lower edge of said panel assembly, means for conveying liquid along a generally horizontal axis, said conveying means having liquid inlets for receiving liquid exiting said panel assembly.

33. A drainage system as in claim 32 wherein said fabric is made from essentially endless elements.

34. A method of providing subterranean insulation and drainage adjacent an up-standing subterranean wall, said method comprising the steps of:

(a) fabricating an insulating and liquid collecting and conveying panel assembly, said panel assembly comprising (i) a board of rigid, foamed polymer and having opposing outer surfaces, one of said outer surfaces having channel means extending inwardly therefrom, the other of said outer surfaces being substantially planar, each of said outer surfaces having a skin and (ii) a covering of a liquid pervious fabric attached to and extending over said one surface of said board and its respective channel means, said fabric having a high stress/strain modulus, such that said fabric cannot be deformed by stretching to substantially intrude into said channels under normal earth loading conditions of typical subterranean foundations;

(b) emplacing, adjacent said wall, means for conveying liquid along a generally horizontal axis, said conveying means having liquid inlets for receiving liquid; and (c) emplacing said panel assembly against said wall and above said conveying means, with said other surface adjacent said wall, and said channel means oriented for channeling liquid downwardly toward said conveying means.

35. A method as in claim 34 wherein said fabric is a spun-bonded polyolefin.

36. A subterranean drainage system made with a panel assembly of claim 11.

37. A subterranean drainage system made with a panel assembly of claim 16.

* * * * *